US011851878B2

(12) United States Patent
Kushner

(10) Patent No.: US 11,851,878 B2
(45) **Date of Patent: *Dec. 26, 2023**

(54) MODULAR BUILDING SYSTEM, APPARATUS AND METHOD

(71) Applicant: Alexander Kushner, San Francisco, CA (US)

(72) Inventor: Alexander Kushner, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/054,117

(22) Filed: Nov. 9, 2022

(65) Prior Publication Data

US 2023/0093082 A1 Mar. 23, 2023

Related U.S. Application Data

(63) Continuation of application No. 17/374,928, filed on Jul. 13, 2021, now Pat. No. 11,499,314.

(51) Int. Cl.

| | |
|---|---|
| ***E04C 3/07*** | (2006.01) |
| ***E04B 2/60*** | (2006.01) |
| ***E04B 7/04*** | (2006.01) |
| ***E04B 5/10*** | (2006.01) |
| *E04C 3/04* | (2006.01) |

(52) U.S. Cl.

CPC ..... *E04C 3/07* (2013.01); *E04B 2/60* (2013.01); *E04B 5/10* (2013.01); *E04B 7/04* (2013.01); *E04C 2003/0473* (2013.01)

(58) Field of Classification Search

CPC .... E04B 1/343; E04B 1/3483; E04B 1/34315; E04B 1/34384; E04B 1/5806; E04B 1/5818; E04B 2/60; E04B 5/10; E04B 7/04; E04C 3/07; E04C 2003/0473

See application file for complete search history.

(56) References Cited

U.S. PATENT DOCUMENTS 2,482,170 A * 9/1949 Gunnison ..... E06B 1/702 52/212
5,671,583 A * 9/1997 Turner ..... E04F 13/06 52/745.15

(Continued)

FOREIGN PATENT DOCUMENTS

CA 2578649 A1 9/2007
CN 1683725 A * 10/2005 ..... E04B 1/24

(Continued)

*Primary Examiner* — Jessie T Fonseca
(74) *Attorney, Agent, or Firm* — Intellectual Property Law Group LLP

(57) ABSTRACT

Described is a method and apparatus for constructing lightweight, modular structures using special openC beams as a top and a bottom frame. Each openC beam comprises a vertical web member, a horizontal top flange extending perpendicularly in a first direction from the vertical web member, a horizontal bottom flange extending perpendicularly in the first direction and substantially parallel with the horizontal top flange and a upper vertical tab extending substantially perpendicularly from a distal edge of the horizontal top flange away from the horizontal bottom flange. Vertical posts are installed in one or more cutouts in the horizontal top flange of each openC beam and a planar surface of each of the vertical posts rests against the horizontal top flange for added support.

17 Claims, 15 Drawing Sheets

(56) References Cited

U.S. PATENT DOCUMENTS

| | | | | |
|---|---|---|---|---|
| 6,360,510 | B1 | 3/2002 | Woodrum | |
| 7,856,763 | B2 | 12/2010 | Keys et al. | |
| 8,276,335 | B2 * | 10/2012 | Waibel | E04B 2/82 52/846 |
| 10,011,983 | B2 * | 7/2018 | Pilz | E04B 1/948 |
| 10,487,497 | B1 * | 11/2019 | Aitken | E04F 13/14 |
| 2005/0086896 | A1 * | 4/2005 | Krumbacher | E04B 2/7457 52/633 |
| 2005/0115192 | A1 * | 6/2005 | Stone | E04C 3/07 52/85 |
| 2016/0017601 | A1 | 1/2016 | Bottin | |
| 2016/0160515 | A1 | 6/2016 | Wallance | |
| 2019/0242129 | A1 | 8/2019 | LeBlang | |

FOREIGN PATENT DOCUMENTS

| | | | | |
|---|---|---|---|---|
| CN | 112942910 | A | 6/2021 | |
| EP | 2807950 | A1 | 12/2014 | |
| GB | 2413834 | A | 11/2005 | |
| WO | WO-2008023086 | A1 * | 2/2008 | E04B 1/2403 |
| WO | WO 2018201203 | A1 | 11/2018 | |

* cited by examiner

MODULAR BUILDING SYSTEM, APPARATUS AND METHOD

CROSS-REFERENCE TO RELATED APPLICATION

This application is a continuation of co-pending U.S. patent application Ser. No. 17/374,928, filed on Jul. 13, 2021, which is incorporated by reference in its entirety herein.

BACKGROUND

I. Field of Use

The present application relates to the home and commercial construction industry. More specifically, the present application relates to a system, apparatus and method for constructing inexpensive, lightweight modular factory built homes and other structures.

II. Description of the Related Art

There currently exists a major housing shortage in the United States. One of the solutions to this problem is the use of prefabricated or modular structures, otherwise known as factory-built homes. These structures are typically manufactured in sections at a controlled factory environment and then shipped to a final destination for assembly and occupancy. These homes are typically much less expensive than traditional "site-built" homes and can be manufactured in far less time and with less waste.

Some modular structures may be constructed of cold-rolled steel beams and heavy gauge steel panels that are joined together using traditional welding techniques. Welding is a time-consuming, dirty, fire and health hazard process requiring specialized labor and specialized welding inspection teams to determine if each weld was properly fashioned. The use of heavy gauge steel results in a very heavy structure, which adds to the cost to move modular sections to an installation site.

It would be desirable to manufacture inexpensive, lightweight structures that can be built in a fraction of the time as traditional modular structures without welding.

SUMMARY

The embodiments described herein relate to a system, apparatus and method for constructing modular structures. In one embodiment, a structure is described, comprising a base frame comprising a first openC profile beam, the first openC profile beam comprising a vertical web member, a horizontal top flange extending perpendicularly in a first direction from the vertical web member, a horizontal bottom flange extending perpendicularly in the first direction and substantially parallel with the horizontal top flange and an upper vertical tab extending substantially perpendicularly from a distal edge of the horizontal top flange away from the horizontal bottom flange, one or more vertical posts coupled to the first openC profile beam at a first end of each of the one or more vertical posts, and a first wall panel coupled to at least one of the one or more vertical posts.

In another embodiment, an openC profile beam is described, used to construct a lightweight structure, comprising a vertical web member, a horizontal top flange extending perpendicularly in a first direction from the vertical web member, a horizontal bottom flange extending perpendicularly in the first direction and substantially parallel with the horizontal top flange and a upper vertical tab extending substantially perpendicularly from a distal edge of the horizontal top flange away from the horizontal bottom flange.

In yet another embodiment, a method for constructing a structure is described, comprising forming a base frame from of a plurality of openC beams, each of the openC beams comprising a vertical web member, a horizontal top flange extending perpendicularly in a first direction from the vertical web member, a horizontal bottom flange extending perpendicularly in the first direction and substantially parallel with the horizontal top flange and a upper vertical tab extending substantially perpendicularly from a distal edge of the horizontal top flange away from the horizontal bottom flange, securing a first end of a plurality of vertical posts, respectively, to at least one of the plurality of openC beams, forming a top frame comprising a second plurality of openC beams, the second plurality of openC beams being inverted with respect to the plurality of openC beams, and securing a second end of the plurality of vertical posts, respectively, to at least one of the second plurality of openC beams.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, wherein the drawings may not be to scale, and wherein.

DETAILED DESCRIPTION

The present application describes a system, apparatus and method for constructing modular structures, such as homes, apartment buildings, accessory dwelling units, warehouses, and other buildings, that are less expensive and less time-consuming to build than traditional structures using heavy gauge steel or other building materials. Structures are manufactured using "openC" beams that form a frame, and then light gauge steel panels are affixed to the frame without welding. Each openC beam comprises a longitudinal member having a cross-section in the shape of a "C", plus a longitudinal tab extending upwards from a horizontal top flange of the "C". While C beams are well known in the construction arts, the addition of the longitudinal tab provides several advantages. For example, the longitudinal tab on each openC beam provides a structural support for vertical posts that are placed through cutouts in the horizontal top flange. The vertical posts may be positioned anywhere along the length of the openC beam as desired, as the longitudinal tab spans the entire length of the openC beam. An additional benefit of the longitudinal tab is that it may be used as a structural surface to affix corrugated wall panels thereto. This, in addition to securing wall panels to the vertical posts, creates an unusually strong structure that is impervious to expected, and even unexpected, loads. Welding is typically not required, due to the structural integrity of each vertical post as it is held in place, contacting the longitudinal tab and an inside surface of a vertical web member of the openC beam. Use of the longitudinal tab is especially inventive in that it provides structural support to a variable number of vertical posts, placed anywhere along a length of an openC beam, without welding. In one embodiment, the longitudinal tab comprises a height of two inches, which is a height specifically chosen as a height sufficient to counteract expected forces or torques against the vertical posts after a structure has been completed. A benefit of using light-weight steel structures over traditional wood-framed structures is that steel is one hundred percent mold and insect resistant. A further benefit of using light-weight steel structures to build structures is that after a full life cycle, the structures are one hundred percent recyclable, unlike wood framed structures, whose materials are generally deposited into landfills after they have exceeded their useful life.

Figure 1:
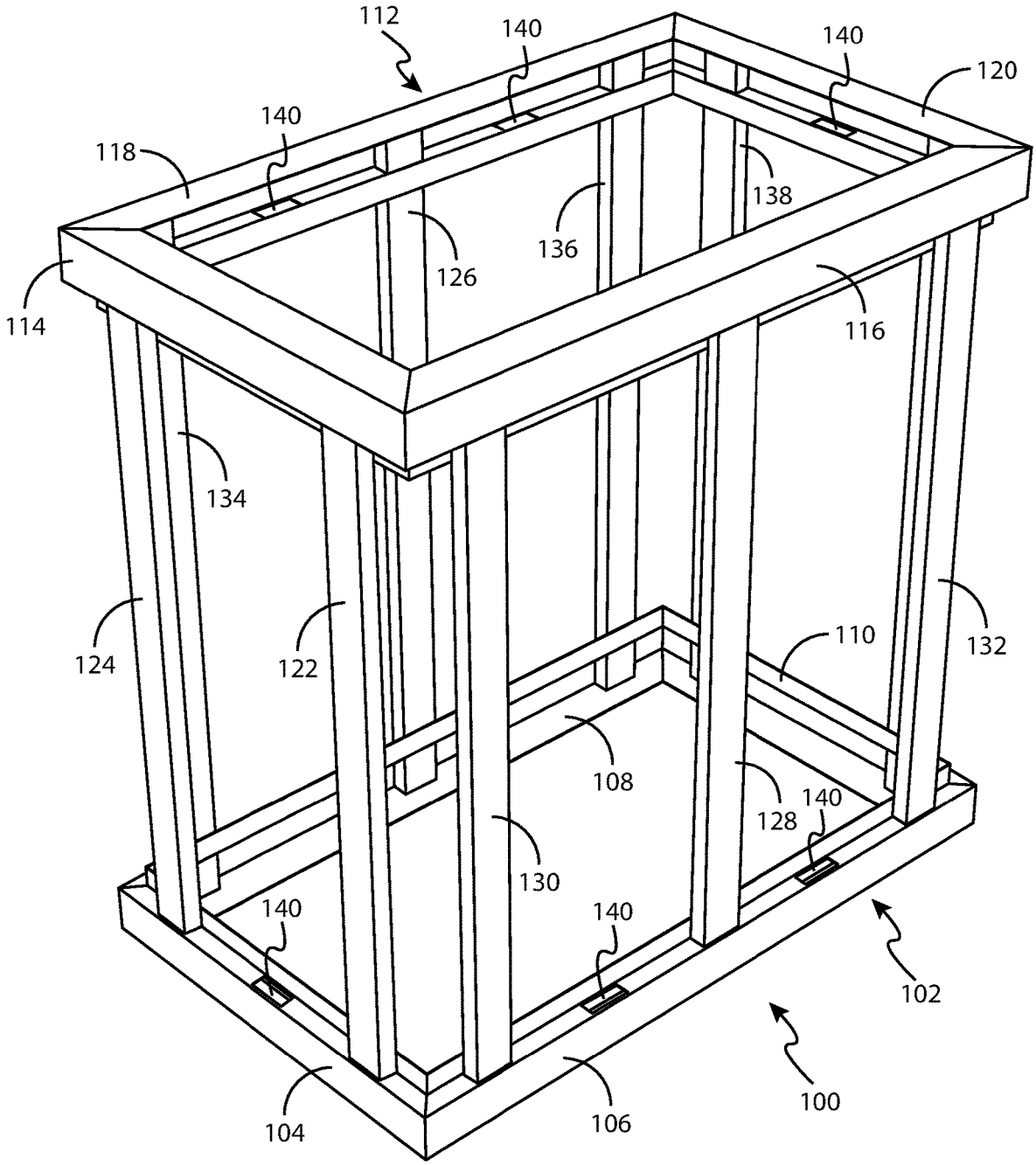
FIG. 1 illustrates a perspective, partial view of one embodiment of a structure constructed using a plurality of openC beams and inverted openC beams.

FIG. 1 illustrates a perspective view of one embodiment of a structure 100 constructed using the inventive principles described herein. In this example, structure 100 comprises a base frame 102 comprising a front openC beam 104, a right openC beam 106, a left openC beam 108, a rear openC beam 110, and a top frame 112 comprising a front, inverted openC beam 114, a right, inverted openC beam 116, a left, inverted openC beam 118, and a rear, inverted openC beam 120. Note that the relative size of each component may not be shown to scale in FIG. 1. "Inverted" means that an openC beam is rotated 180 degrees in a theoretic horizontal plane parallel to a vertical web member of an openC beam.

Structure 100 also comprises vertical posts 122-138, one or more side panels (shown later herein), one or more floor panels (shown later herein) and roof panels (shown later herein). In some embodiments, structure 100 additionally comprises one or more corner posts (shown later herein). In this embodiment, structure 100 is twelve feet wide, twenty four feet long and eight feet high. It should be understood that although structure 100 is shown in FIG. 1 as comprising a simple box-like structure comprising a total of eight openC beams and nine vertical posts, in other embodiments, a greater or fewer number of openC beams and/or posts may be used, while the dimensions of the openC beams and/or posts may be different as well. In the embodiment shown in FIG. 1, structure 100 may be used to construct a one-bedroom dwelling, while in another embodiment, where structure 100 is twelve feet wide and thirty six feet long, structure 100 may be used to construct a two bedroom dwelling. Of course, structure 100 may be used to construct structures other than dwellings, such as warehouses and light-industrial buildings. Additionally, structure 100 could comprise two or more structures 100 stacked on top of each other, secured together using fasteners such as screws, bolts or rivets. In this case, a lower structure may not require a roof, as a floor of an upper structure may be all that is needed to form a separation between the two. Conversely, a lower structure may comprise a roof, but the upper structure may lack a floor. In either case, a lighter overall structure is achieved, lowering construction and shipping costs by eliminating the need for a roof or a floor, respectively.

Figure 2:
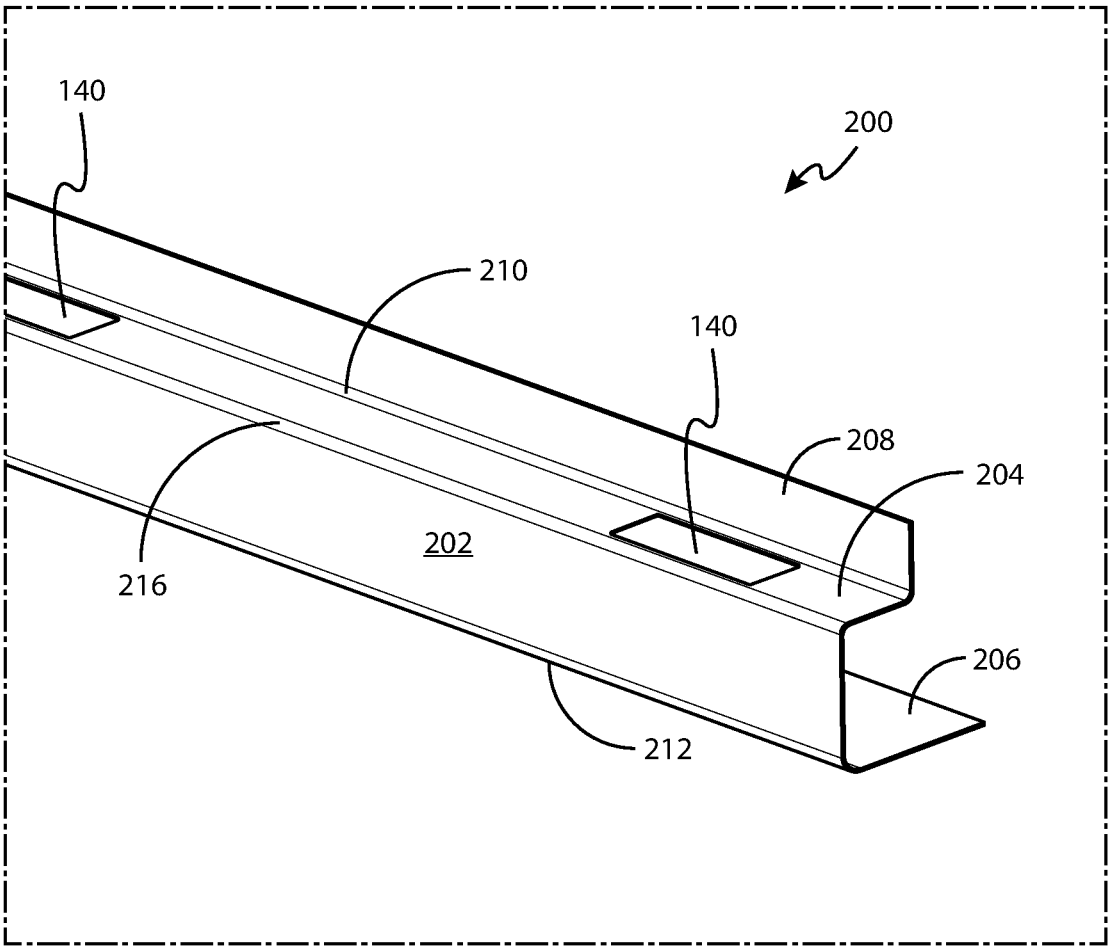
FIG. 2 is a perspective view of one embodiment of one of the openC beams as shown in FIG. 1.

As mentioned previously, structure 100 is formed of a plurality of openC beams forming base frame 102 and top frame 112, and each openC beam generally comprises one or more cutouts 140. FIG. 2 is a perspective view of one embodiment of one of such openC beams, shown as openC beam 200. OpenC beam 200 comprises a vertical web member 202, a horizontal top flange 204 extending perpendicularly in a first direction from vertical web member 202, a horizontal bottom flange 206 extending perpendicularly in the first direction and substantially parallel with horizontal top flange 204 and an upper vertical tab 208 extending substantially perpendicularly from horizontal top flange 204 in a direction away from horizontal bottom flange 206.

Figure 3A:
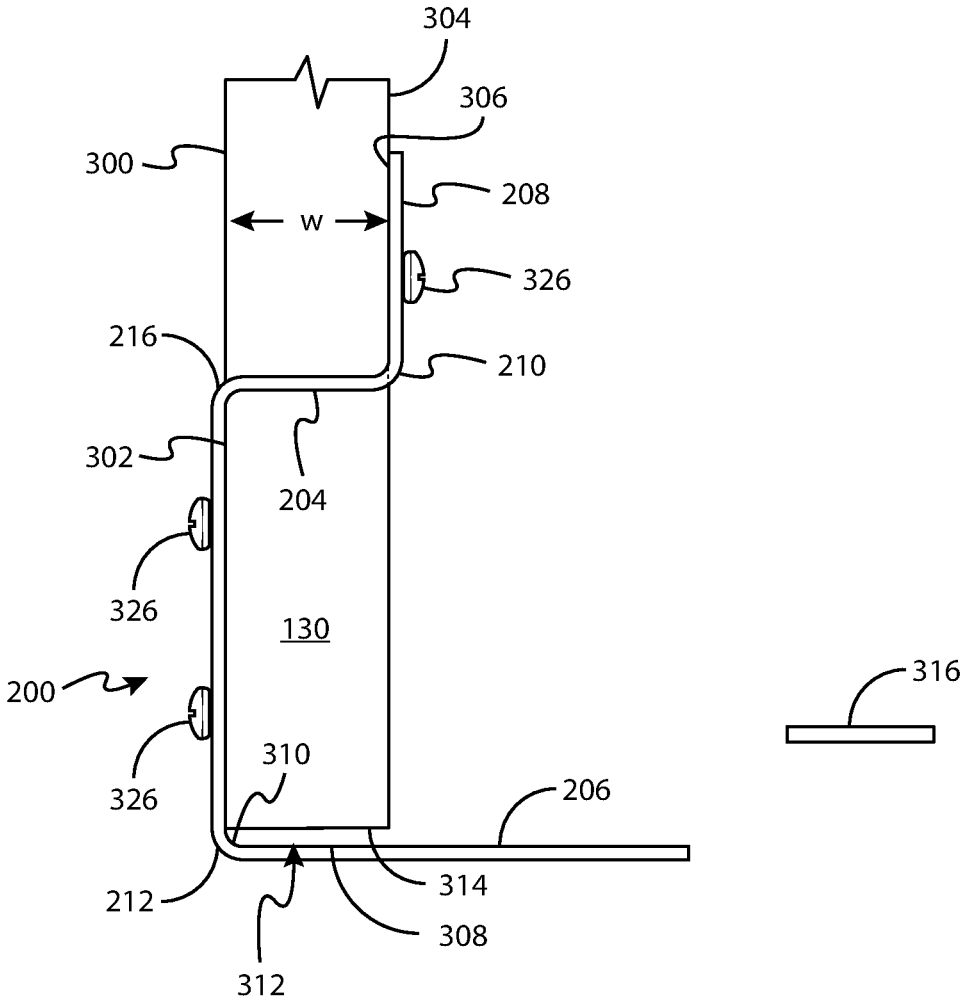
FIG. 3A is a side view of the openC beam shown in FIG. 2 in one embodiment, showing a cross-section of the openC beam, with a vertical post, shown in a side view, secured through a cutout in a horizontal top flange of the openC beam.
Figure 3B:
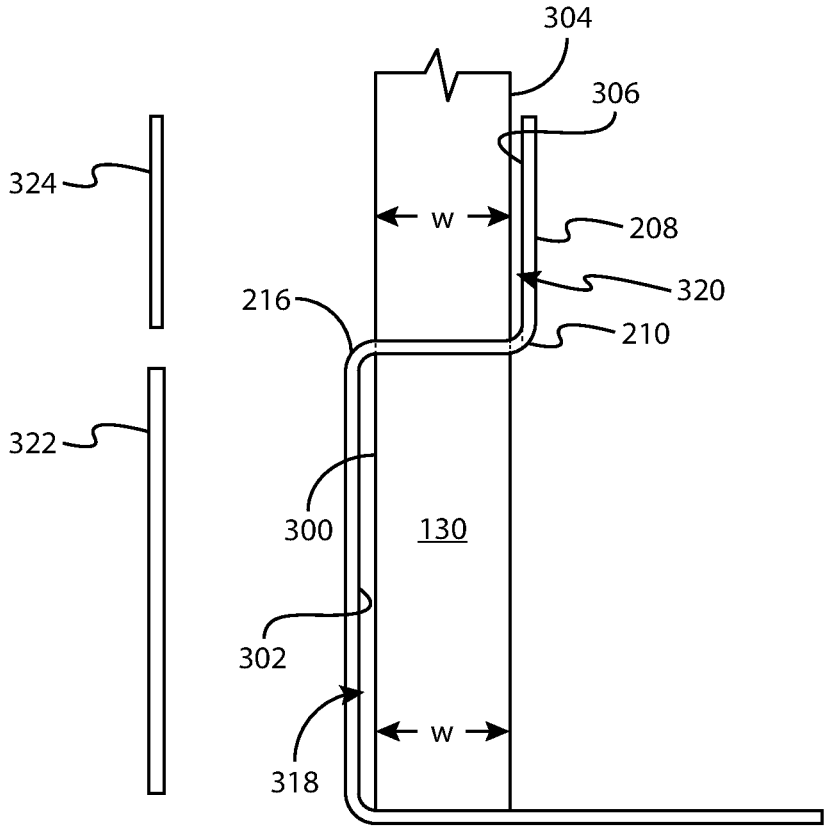
FIG. 3B is a side view of the openC beam shown in FIG. 2 in another embodiment, showing a cross-section of the openC beam, with a vertical post, shown in a side view, secured through a cutout in a horizontal top flange of the openC beam.

OpenC beam 200 additionally comprises one or more cutouts 140. Each cutout 140 comprises one or more openings in horizontal top flange 204, each sized and shaped to accommodate a respective vertical post as shown in FIG. 1. Thus, in this embodiment, since the vertical posts are rectangular in cross-section, the cutouts 140 in this embodiment are shaped in the form of a rectangle having dimensions equal to or just slightly larger than the cross-sectional dimensions of the vertical posts. In one embodiment, the cutouts 140 each span the entire width of horizontal top flange 204, including any bend radii that may be present as a result of the fabrication process, described below. In another embodiment, the cutouts 140. FIGS. 3A and 3B illustrate these concepts.

FIG. 3A is a side view of openC beam 200 in one embodiment, showing a cross-section of openC beam 200, with a vertical post 130, shown in a side view, secured through a cutout 140. In this embodiment, the cutouts 140 span a width w, where the cutouts 140 encroach on the bend radii or "folds" 216 and 210 as shown. A first surface 300 of vertical post 130 inside openC beam 200 rests against an inner surface 302 of vertical web member 202 while a second, opposing surface 304 rests against surface 306 of upper vertical tab 208. In this embodiment, a bottom surface 314 of vertical post 130 may not rest on top of inner surface 308 of horizontal bottom flange 206 due to interference caused by an inside fold 310 of vertical post 130, potentially creating a small gap 312 between bottom surface 314 of vertical post 130 and inner surface 308 of horizontal bottom flange 206. Gap 312 may be eliminated by inserting a thin, rigid shim 316 between bottom surface 314 and inner surface 308 of horizontal bottom flange 206, or by rounding a corner of vertical post 130 to match an inner radius of fold 212. Vertical post 130 is secured in place through cutout 140 via one or more fasteners 326 such as screws, rivets, bolts or some other known fasteners, through vertical web member 202 and upper vertical tab 208 into vertical post 130, respectively.

FIG. 3B is a side view of openC beam 200 in another embodiment, showing a cross-section of openC beam 200, with a vertical post 130, shown in a side view, secured through a cutout 140. In this embodiment, the cutouts 140 also spans a width w, approximately equal to a thickness of vertical post 130. However, in this embodiment, the cutout 140 does not encroach on either fold 216 or 210. In other words, cutout 140 is formed only in a horizontal portion of horizontal top flange 204. This results in a gap 318 between first surface 300 of vertical post 130 and inner surface 302 of vertical web member 202, as well as a gap 320 between second, opposing surface 304 and surface 306 of upper vertical tab 208. Each gap is approximately equal to the bend radius of the folds 216 and 210, respectively. In order to secure vertical post 130 securely within cutout 218, a shim or washer 324 may be placed into gap 318 prior to insertion of vertical post 130, and a second shim or washer 324 placed between second, opposing surface 304 and surface 306 of upper vertical tab 208. In other embodiments, the gaps may be so small as to be almost insignificant, and post 130 may be secured in place using one or more fasteners 136 through vertical web member 202 and upper vertical tab 208, leaving the gaps as-is.

Referring back to FIG. 2, openC beam 200 is typically fabricated from a single sheet of metal, hot or cold rolled steel, galvanneal, etc., and bent into the shape shown in FIG. 2 using known bending machinery, such as a bending brake, a pressing brake, hydraulic press, cold rolling machinery, etc. or extruded from aluminum bar. The thickness of openC beam 200 may vary, generally between 14 gauge and 8 gauge, with heavier gauges used in building larger structures. Folds 210, 216 and 212 are generally formed as a natural result of the fabrication process. The radius of the rounded edges may vary depending on the thickness of the sheet metal used to form openC beam 200 as well as the type of fabrication machinery. A typical bend radius for each of folds 210, 216 and 212 using 12 gauge cold-rolled steel is approximately 0.085 inches.

The dimensions of openC beam 200, in this embodiment, is twelve feet long, vertical web member 202 is four inches high, horizontal bottom flange 206 is four inches wide, horizontal top flange 204 is one and a half inches wide and upper vertical tab 208 is two inches high. Some or all of these dimensions may be changed in other embodiments, depending on the loads exerted by the size and weight of structure 100. The width of horizontal top flange 204 is generally sized to match an approximate thickness of one of the vertical posts shown in FIG. 1, plus an amount to account for additional width due to folds 210 and 216, in some embodiments. The dimensions of each cutout 140 is approximately a width and a depth of one of the vertical posts shown in FIG. 1.

Figure 4:
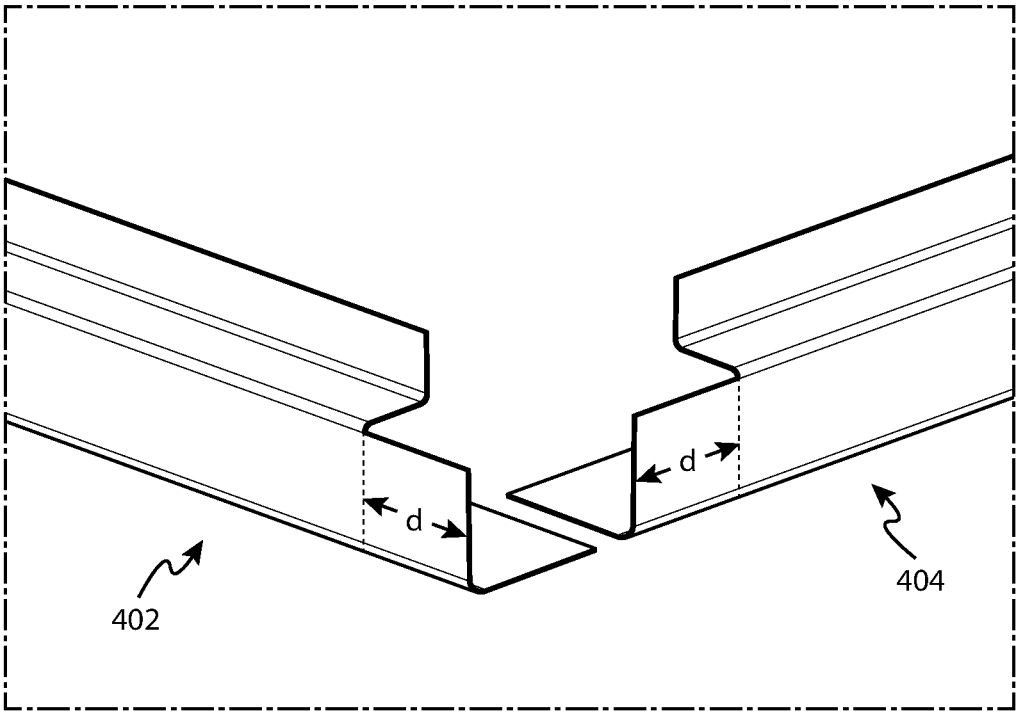
FIG. 4 is a perspective view of one embodiment of how openC beams may be coupled together at the corners.

FIG. 4 is a perspective view of one embodiment of how openC beams may be coupled together at the corners. FIG. 4 shown two openC beams, 402 and 404, about to be joined together at a right end of openC beam 402 and a left end of openC beam 404. Each of the beams shown has at least one end where horizontal top flange 204 and upper vertical tab 208 terminate a predetermined distance d from the end of vertical web member 202 and horizontal bottom flange 206.

Figure 5:
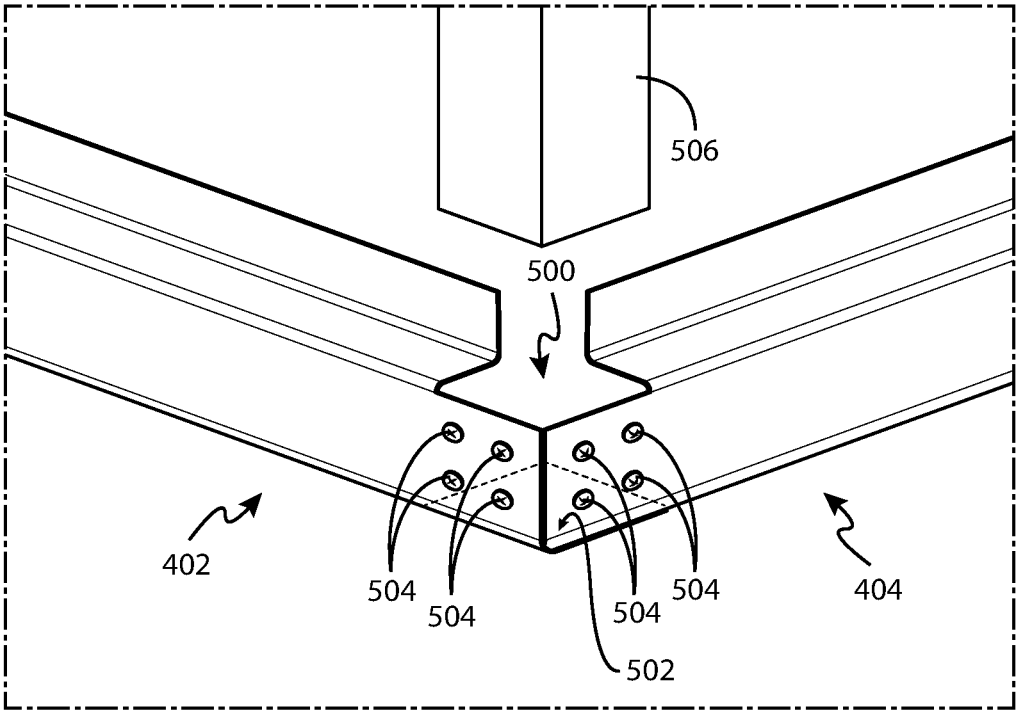
FIG. 5 is a perspective view of the embodiment of FIG. 4, showing the two beams coupled to each other.

FIG. 5 is a perspective view of the embodiment of FIG. 4, showing the two beams coupled to each other. When joined, an open space 500 is formed that allows a corner post 506 to be inserted into the open space 500, resting on top of a portion 502 of the intersection of horizontal bottom flange 206 of both beams. Corner post 506 may then be secured to vertical web member 202 of each of the beams using fasteners 504, such as screws, bolts, rivets, etc.

Figure 6:
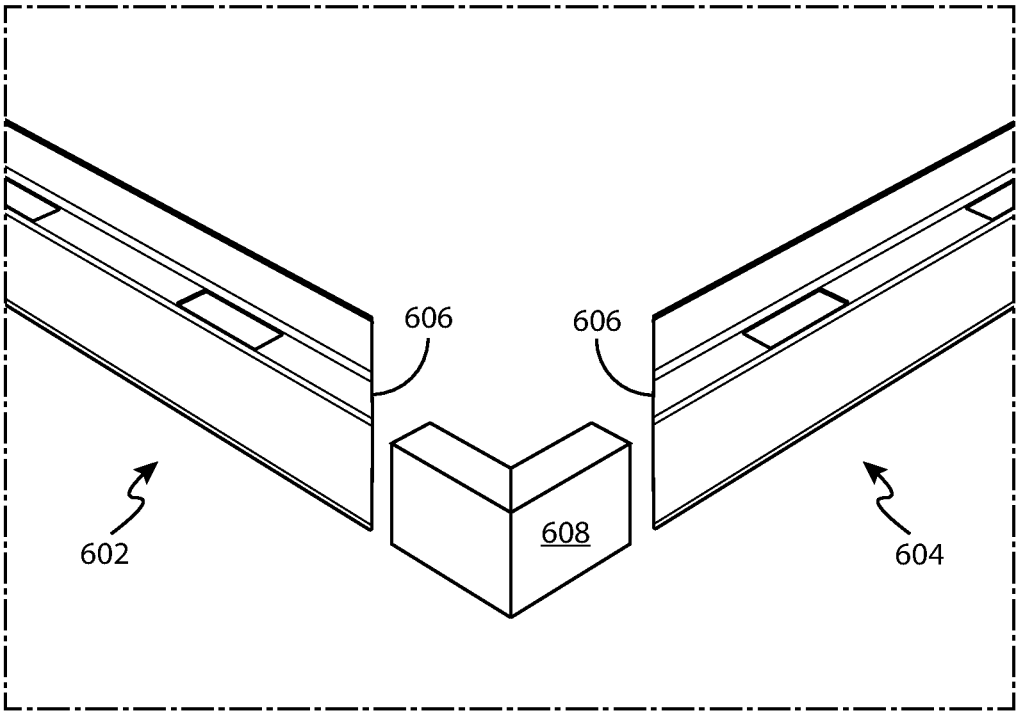
FIG. 6 is a perspective view of another embodiment of how openC beams may be coupled together at the corners.
Figure 7:
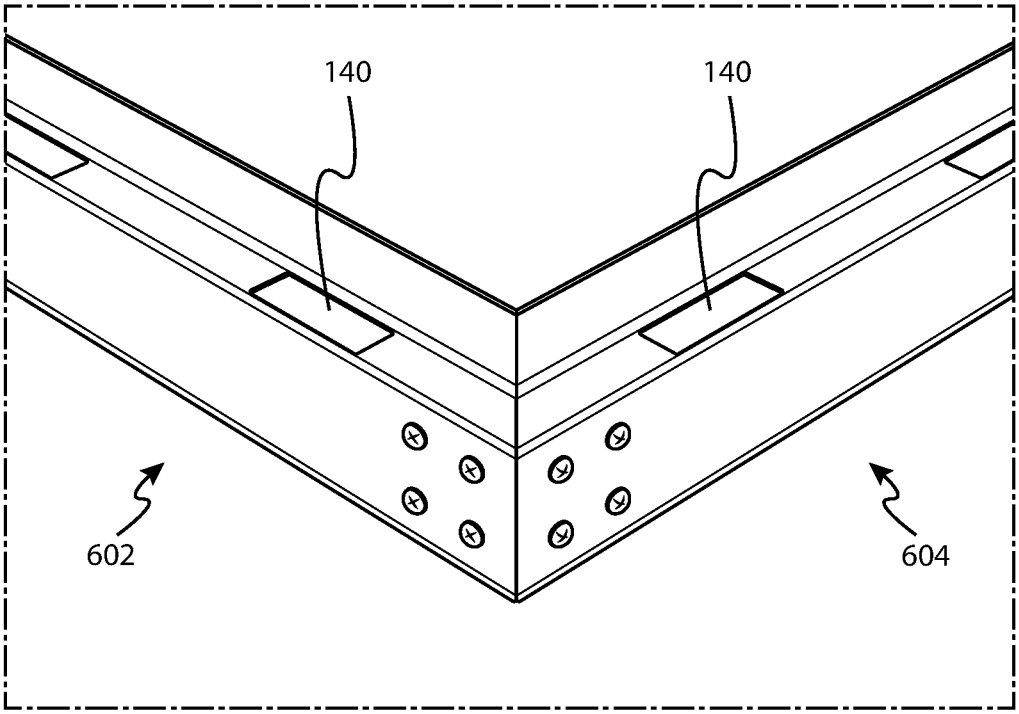
FIG. 7 illustrates a perspective view of the joinder of the two openC beams and insert as shown in FIG. 6.

FIG. 6 is a perspective view of another embodiment of how openC beams may be coupled together at the corners. FIG. 6 shown two openC beams, 602 and 604, about to be joined together at a right end of openC beam 602 and a left end of openC beam 604. Each of the beams shown has at least one end that is cut diagonally, typically at a 45 degree angle from an edge 606 of each openC beam. With each end cut diagonally, a right end of openC beam 602 and a left end of openC beam 604 meet along the edges of upper vertical tab 208, horizontal top flange 204, vertical web member 202 and horizontal bottom flange 206. In another embodiment, horizontal bottom flange 206 is not cut diagonally, leaving horizontal bottom flange 206 the same as shown in FIGS. 2 and 4, i.e., squared off. In this embodiment, the horizontal bottom flange 206 from each openC beam overlap each other, as shown in FIG. 5. In either case, an L-shaped insert 608 may be used to increase the joint strength by inserting a left end of the insert 608 into the right end of openC beam 602 and then sliding the left end of openC beam 604 onto a right end of insert 608. The insert 608 may then be secured in place using one or more fasteners, such as screws, rivets, bolts, etc. FIG. 7 illustrates a perspective view of the joinder of openC beam 602 with openC beam 604 in such manner.

Figure 8A:
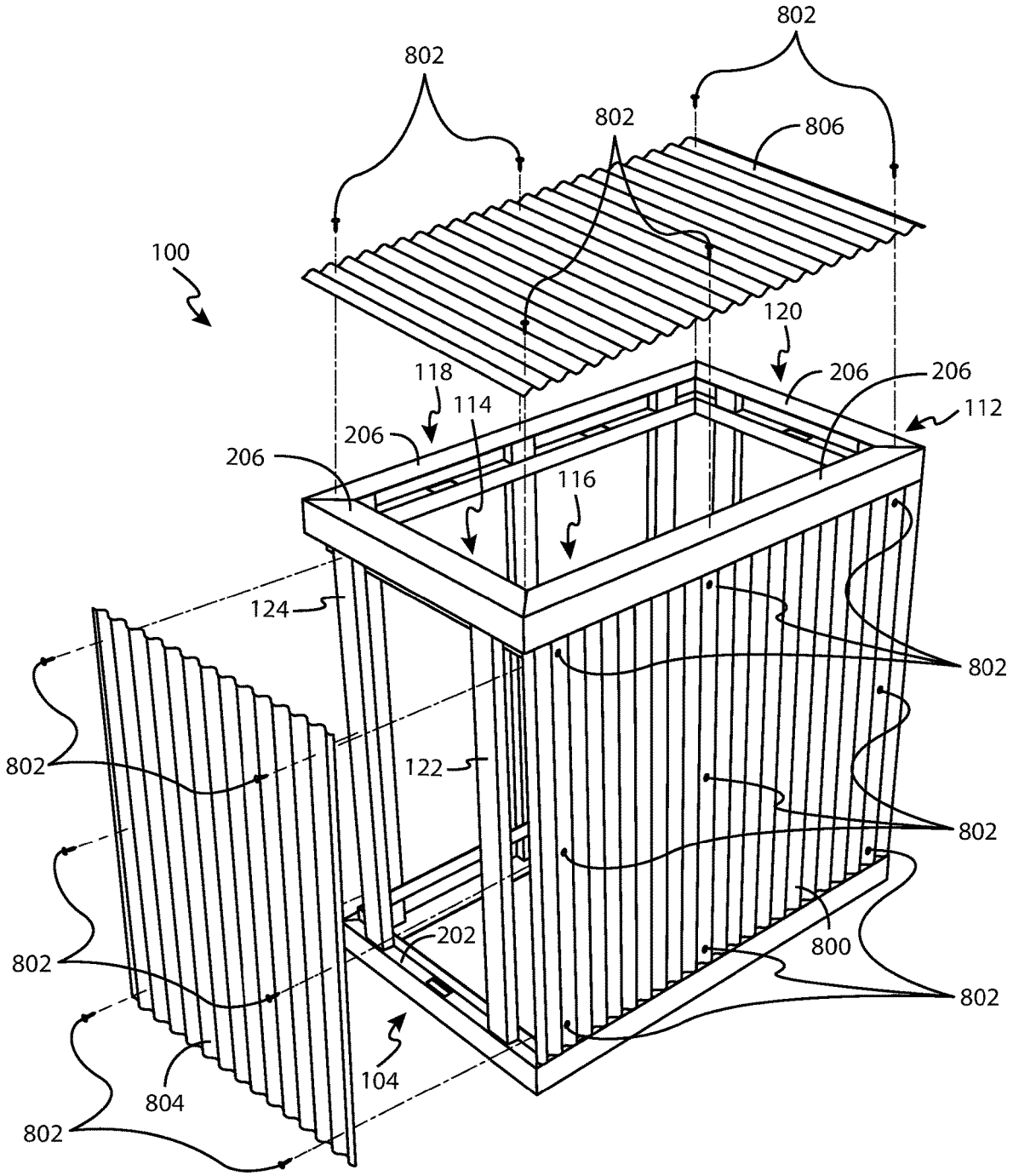
FIG. 8A is a perspective view of one embodiment of the structure shown in FIG. 1, showing how side panels and a roof panel are secured to openC beams and to vertical posts.

FIG. 8A is a perspective view of one embodiment of structure 100 showing how side panel 800 and 802, and a roof panel 806, are secured to the openC beams and to the vertical posts. In this embodiments, side panel 800 is secured to a right side of structure 100 via, in this example, nine fasteners 802, while front panel 804 is shown in an exploded view, with six fasteners positioned to secure front panel 804 to a front side of structure 100 against two vertical posts 122 and 124 and/or against vertical web member 202 of openC beam 104 and against vertical web member 202 of inverted openC beam 114, as explained in further detail below. Roof panel 806, likewise, is fastened to a horizontal bottom flange 206 of each of openC beams 114, 116, 118 and 120 using, in this example, six fasteners 802. Fasteners 802 comprise screws, rivets, bolts or some other well-known fasters. In one embodiment, fasteners 802 comprise size 8 or 10 sheet metal screws, making it quick and easy to construct structure 100 without expensive and time-consuming welding.

Figure 8B:
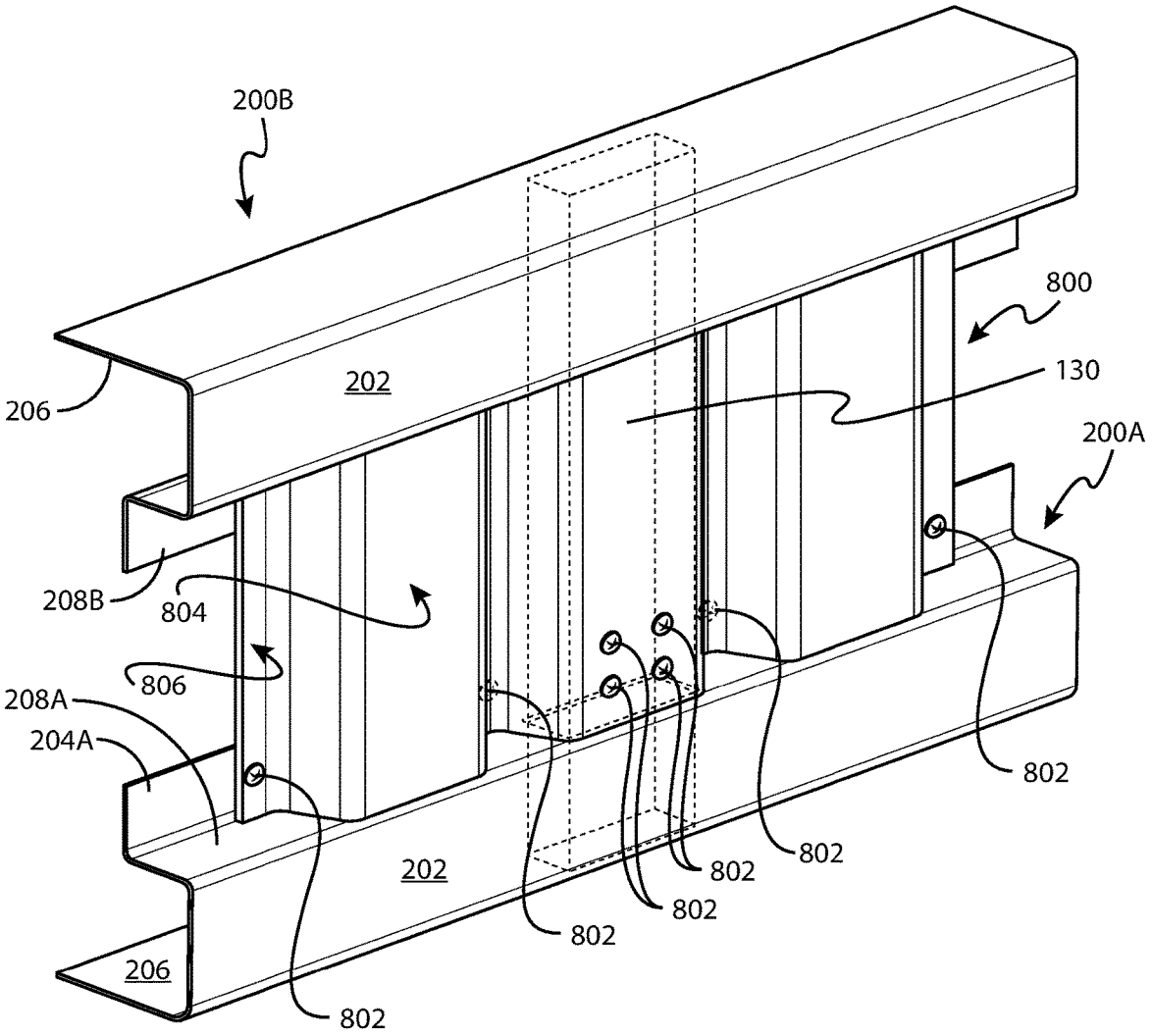
FIG. 8B is a perspective view of the structure of FIG. 1 showing how a side panel may be attached to the vertical posts and openC beams to create exterior walls.

FIG. 8B is a perspective view of a portion of the structure 100 of FIG. 1 showing how a side panel 800 may be attached to the vertical beams and openC beams to create exterior walls. The height of vertical post 130 and side panel 800 has been shortened dramatically, in order to show the detail of how side panel 800 fits in between horizontal top flange 204A of openC beam 200A and horizontal top flange 204B of inverted, openC beam 204B. In this embodiment, side panel 800 comprises a steel corrugated panel comprising a series of alternating ridges 804 and valleys 806. Generally, side panel 800 is several feet in height and width and, in this embodiment, approximately 1½ in thick, i.e., a perpendicular distance from a theoretical plane of the ridges 804 to a theoretical plane of the valleys 806. In general, the height of side panel 800 is approximately equal to the distance between horizontal top flange 204A of openC beam 200A, and horizontal top flange 204B of inverted, openC beam 204B. In other words, side panel 800 lies over the vertical posts and in between the horizontal top flanges of the upper and lower openC beams.

Figure 8C:
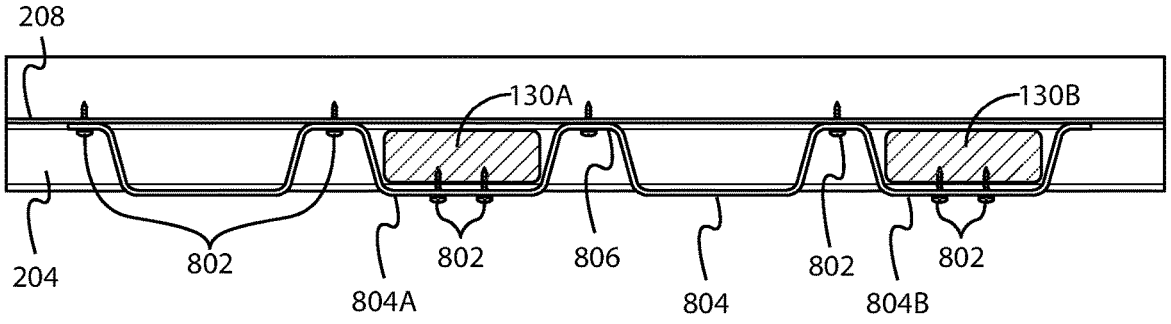
FIG. 8C is a top, plan view looking downward on the structure shown in FIG. 8B.

The ridges 804 are generally sized and shaped so that they fit over the vertical posts 130, as shown. In this embodiment, two or more vertical posts 130 are installed into a lower openC beam 200A and into an upper, inverted openC beam 200B, the vertical posts spaced apart so that the width between posts is a multiple of the distance between the ridges 804. In this way, in the case of side panel 800 covering two or more vertical posts 130, side panel 800 will fit onto the vertical posts 130 such that each vertical post rests within a respective ridge 804. This is shown in FIG. 8C, which is a top, plan view looking downward on the structure shown in FIG. 8B, with side panel 800 secured to two vertical posts 130A and 130B, the vertical posts spaced apart from one another a distance of every other ridge 804. This view shows how vertical post 130A is seated into a space created by ridge 804A while vertical post 130B is seated into a space created by ridge 804B. Side panel 800 is secured to the vertical posts, to upper vertical tab 208A of lower openC beam 200A and to upper vertical tab 208B of lower openC beam 200A using a plurality of fasteners 802. Securing side panel 800 to both the vertical posts and to the upper vertical tabs of the openC beams results in a structure that is exceedingly strong and able to withstand expected, and even unexpected, loads.

Figure 9:
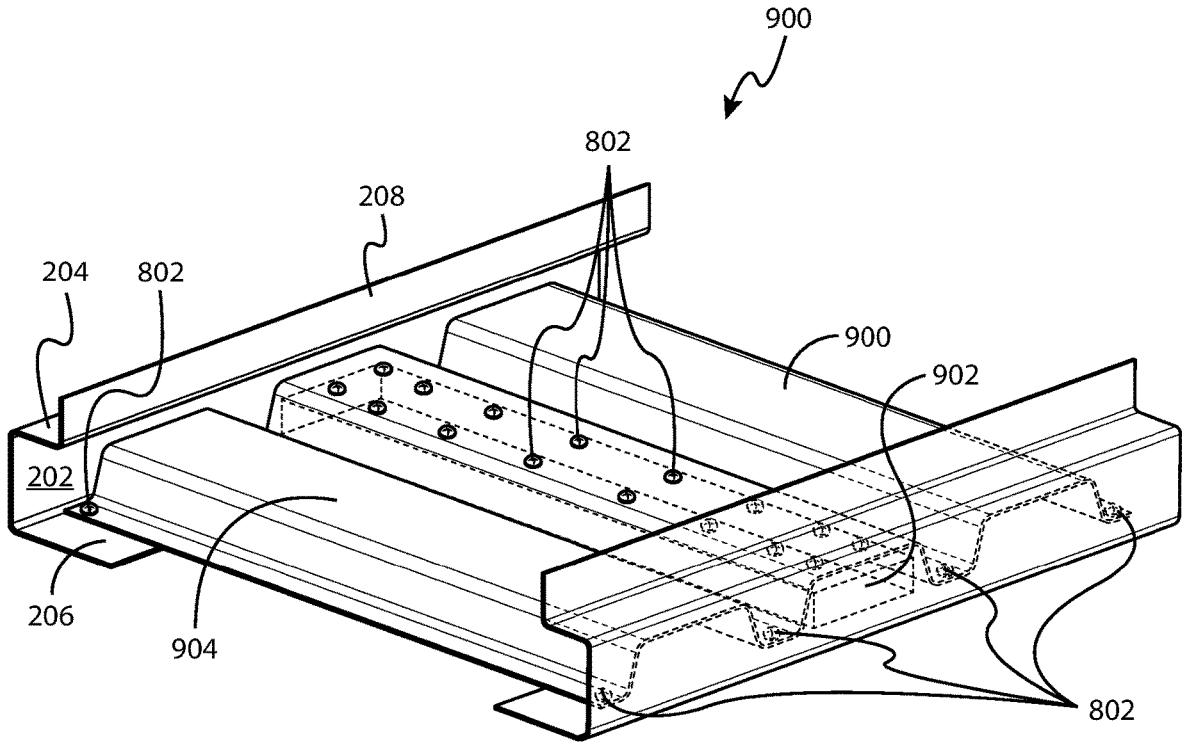
FIG. 9 is a perspective, close-up view of one embodiment of how a floor may be installed onto a base frame of the structure shown in FIG. 1.

FIG. 9 is a perspective, close-up view of one embodiment of how a floor may be installed onto base frame 102. In this embodiment, each end of a floor panel 900 is partially inserted into a space formed by horizontal bottom flange 206, vertical web member 202 and horizontal top flange 204 of two, opposing openC beams of base frame 102. In one embodiment, floor panel 900 comprises one or more rigid metal panels, comprising one or more corrugated cold-rolled steel sheets, each sheet measuring three feet by twelve feet, although the measurements could be greater or less in either dimension in other embodiments. In one embodiment, where a height of vertical web member 202 is four inches, a height of floor panel 900 (i.e., a perpendicular distance from a valley to a ridge of floor panel 900) may be approximately three inches, leaving a gap between a the ridges and an underside of horizontal top flange 204 for access to electrical wiring, plumbing, and/or other infrastructure that may be routed through the openC beams via the space formed by horizontal bottom flange 206, vertical web member 202 and horizontal top flange 204. Floor panel 900 generally rests on horizontal bottom flange 206 and secured thereto using a plurality of fasteners 802.

In one embodiment, at least one floor beam 902 is used to provide additional strength to floor panel 900, for example where extra strength may be needed such as where interior wall partitions may be located or in areas where heavy appliances such as stoves, refrigerators, washers and/or dryers may be located. In one embodiment, each floor beam 902 comprises a beam that is three inches high by three inch wide and having a length able to span a distance between opposing openC floor beams, although in other embodiments, these dimensions may be different. Floor beam 902 is typically made of steel or some other rigid material, resting on respective horizontal lower flange 206 of two, opposing openC floor beams and secured thereto by one or more fasteners (not shown). When multiple floor beams 902 are used, they are typically spaced apart from each other so that the width between floor beams 902 is a multiple of the distance between ridges 904 of floor panel 900. In this way, floor panel 900 will fit onto the floor beams 902 such that each floor beam 902 rests within a respective ridge 904. Ridges 904 are generally sized and shaped so that they fit over the floor beams 902, as shown. Floor panel 900 is typically secured to one or more of the floor beams 902 to both the vertical posts and to the upper vertical tabs of the openC beams results in a structure that is exceedingly strong and able to withstand expected, and even unexpected, loads.

Figure 10:
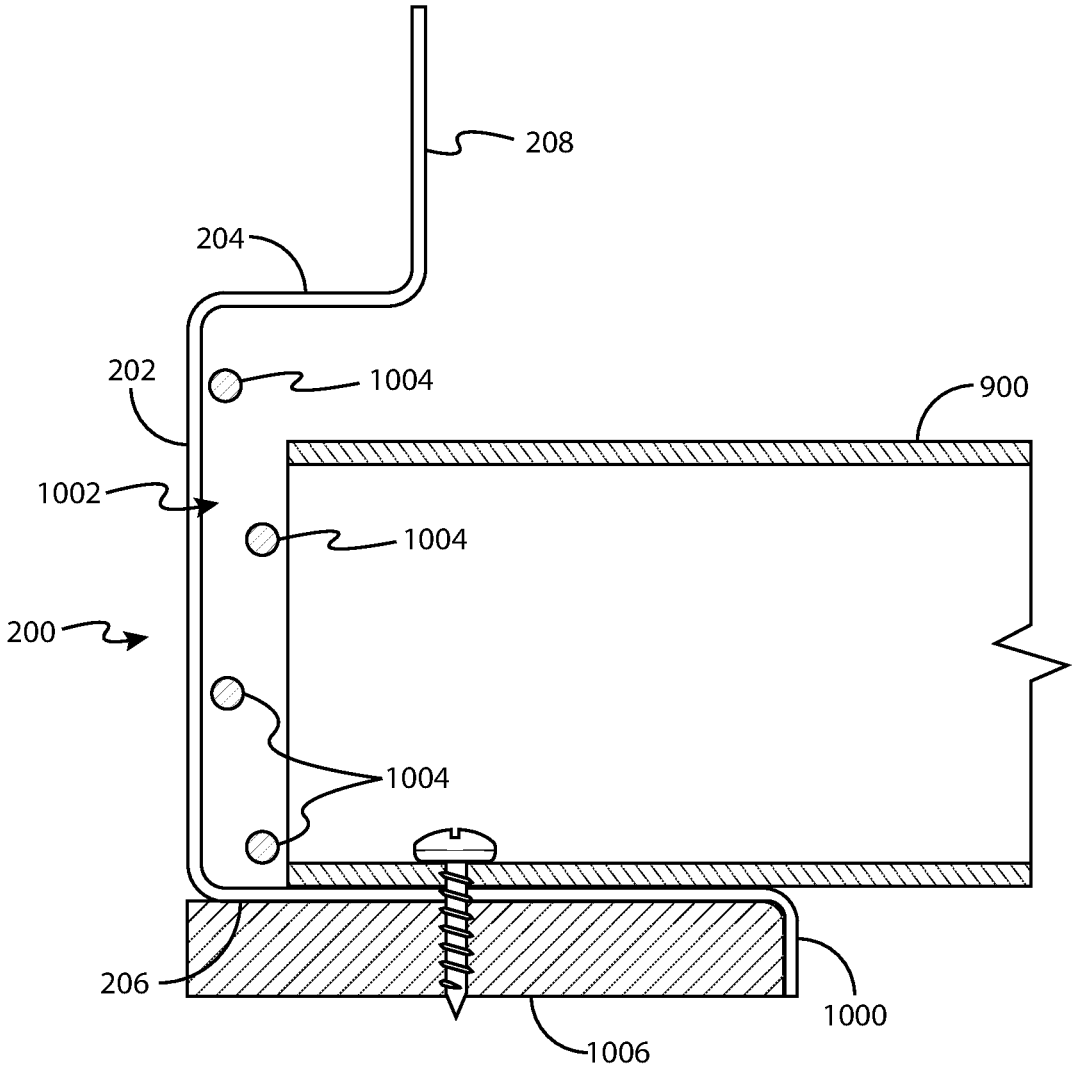
FIG. 10 is a side view of a floor panel and openC beam as shown in FIG. 9, illustrating how the floor panel is coupled to openC beam.

FIG. 10 is a side view of FIG. 9 illustrating how floor panel 900 is positioned and coupled to openC beam 200. In this embodiment, openC beam 200 additionally comprises a longitudinal tab 1000 extending downward and substantially perpendicular to a planar surface of floor panel 900 along an entire length of openC beam 200. During installation, each end of floor panel 900 is inserted into a respective space 1002 formed by horizontal bottom flange 206, vertical web member 202 and horizontal top flange 204 of a respective openC beam, one of such ends shown in FIG. 10. Generally, floor panel 900 is positioned such as to leave a portion of space 1002 available for electrical wiring and/or plumbing 1004, shown in an end view. In one embodiment, floor panel 900 is secured through horizontal bottom flange 206 and into a longitudinal insert 1006, more fully described in FIG. 11, below, using a plurality of fasteners 1002, such as screws, rivets, bolts or some other well-known mechanical fastening device.

Figure 11:
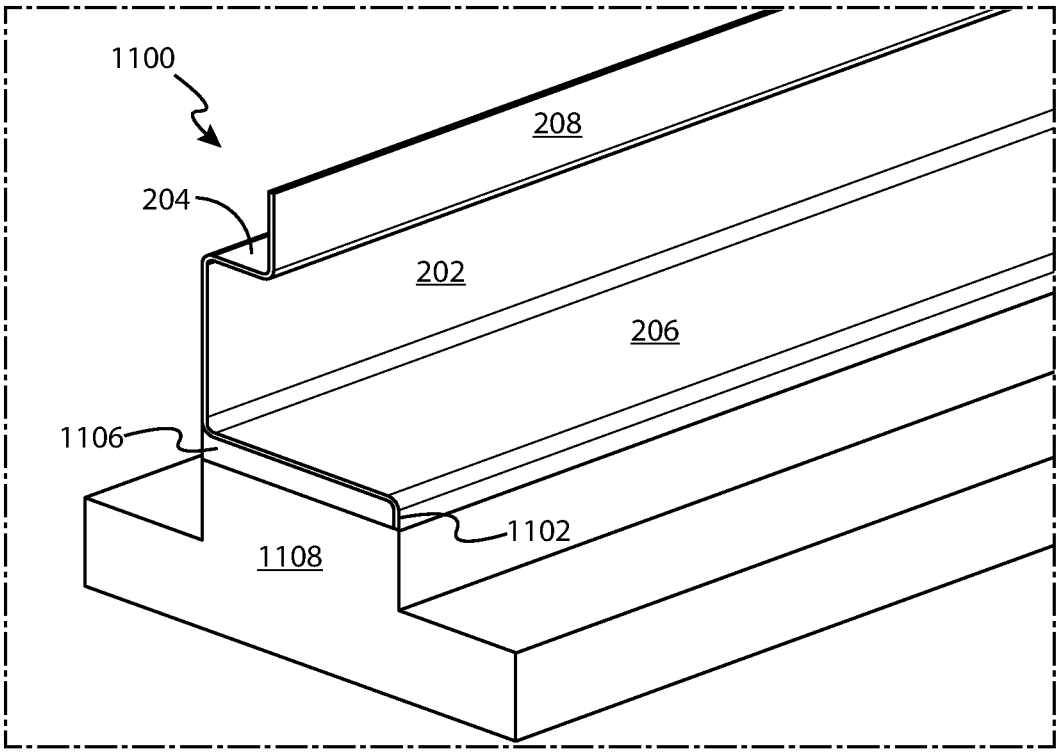
FIG. 11 is a perspective view of another embodiment of an openC beam.

FIG. 11 is a perspective view of another embodiment of an openC beam. In this embodiment, openC beam 1100 is a modification of openC beam 200 as shown in FIG. 2, further comprising a substantially perpendicular lower vertical tab 1000, generally spanning a length of openC beam 1100. Lower vertical tab 1000 is used to secure openC beam 1100 to a longitudinal insert 1006 installed into a space formed by lower vertical tab 1000 and vertical web member 202 Specifically, lower vertical tab 1000 prevents lateral movement of openC beam 1100 relative to longitudinal insert 1006. Longitudinal insert acts as a good separating material between foundation 1102 and openC beam 200 and additionally is well-suited to receive fasteners 802 used to secure floor panel 900 to horizontal bottom flange 206. Without longitudinal insert 1006, the fasteners 802 securing floor panel 900 to horizontal bottom flange 206 may undesirably protrude from horizontal bottom flange 206. Longitudinal insert 1006 comprises a rigid material able to withstand the weight of openC beam 1100 plus additional weight from any vertical posts, top frame 112, roof panels, and any other materials used in the construction of a wall on top of openC beam 1100, such as plastic, metal, etc. In one embodiment, longitudinal insert 1006 comprises the well-known TREX® composite plastic. During construction at a manufacturing facility, longitudinal insert 1006 may be affixed to the space formed by lower vertical tab 1102 and bottom horizontal flange 206 using traditional fixation materials such as glue or other fasteners, such as screws, rivets, bolts, etc. In another embodiment, longitudinal insert 1006 is installed into the space at a construction site. In some embodiments, glue or other fasteners are not used, and the weight of openC beam 1100 plus other components of structure 100 hold longitudinal insert 1006 in place. In one embodiment, the combination of openC beam 1100 and longitudinal insert 1006 is placed on top of a durable foundation 1108, such as a concrete foundation, that defines a footprint of structure 100 built using a plurality of openC beams 1100.

In one embodiment, lower vertical tab 1102 extends three quarters of an inch from horizontal bottom flange 206 with a thickness the same of other components of openC beam 1100, i.e., between 8 and 14 gauge. Of course, in other embodiments, lower vertical tab 1102 may extend a greater, or less, distance from horizontal bottom flange 206. Longitudinal insert 1106 is typically the same thickness as the height of lower vertical tab 1102, with a width approximately equal to the width of horizontal bottom flange 206 and a length generally spanning the length of openC beam 1100.

Figure 12:
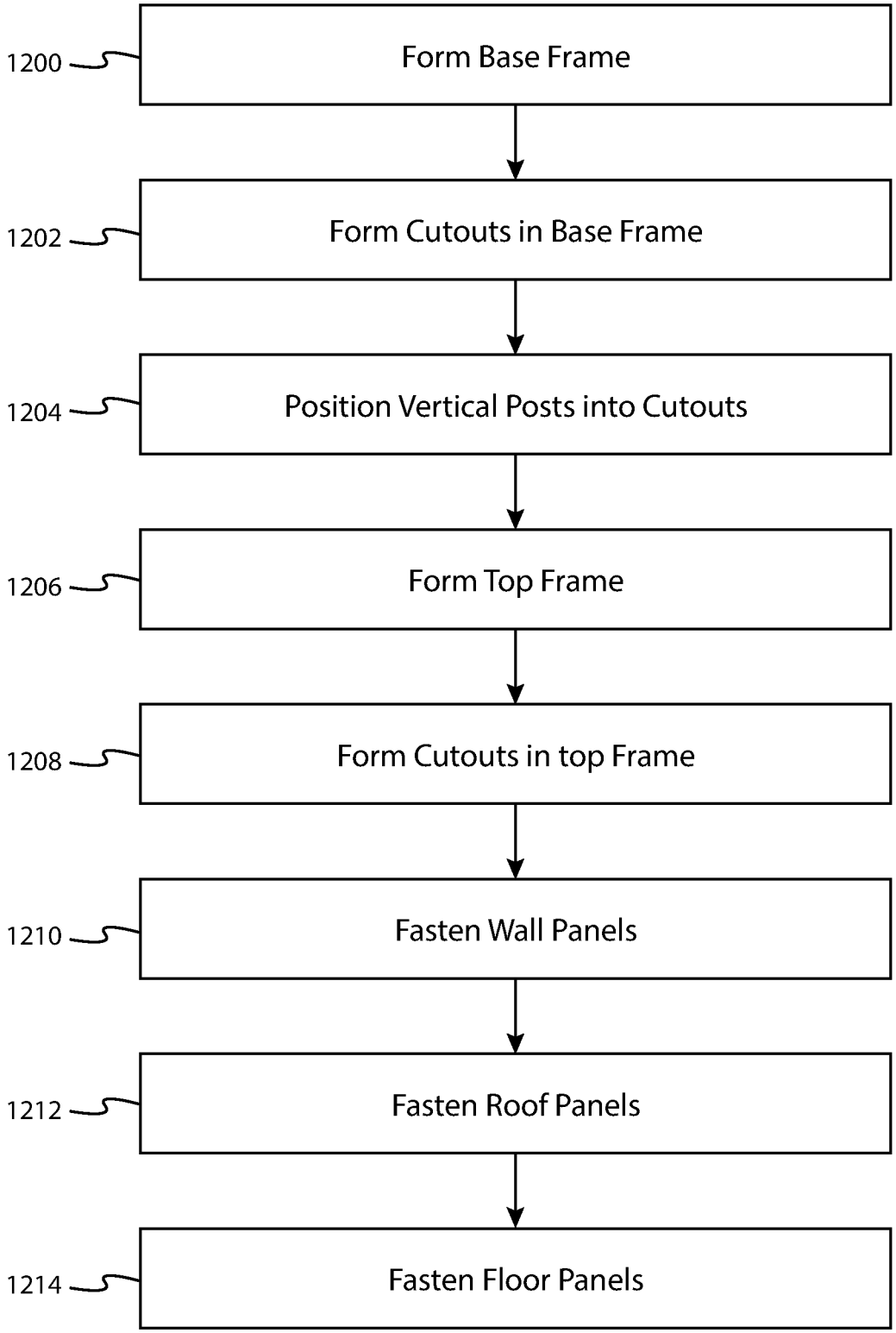
FIG. 12 is a flow chart illustrating one embodiment of a method for constructing the structure shown in FIG. 1.

FIG. 12 is a flow chart illustrating one embodiment of a method for constructing structure 100. It should be understood that in some embodiments, not all of the method steps shown in FIG. 12 are performed, and that the order in which the steps are performed may be different in other embodiments.

In step 1200, base frame 102 is formed from a plurality of openC beams, joined together as described earlier herein.

In step 1202, a plurality of cutouts 118 are formed in the horizontal top flange of each of the openC beams. The number and placement of the cutouts may be dependent on the size and/or type of structure being built. The cutouts may be placed anywhere along the length of the openC beams.

In step 1204, a plurality of vertical posts are positioned into the plurality of cutouts, respectively by placing a first end of each vertical post through a respective cutout, and then securing the first end to the openC beam using fasteners as described above.

In step 1206, a top frame is formed from a plurality of inverted openC beams, joined together as described earlier herein.

In step 1208; a plurality of cutouts 140 are formed in the horizontal top flange of each of the inverted openC beams. The number and placement of the cutouts are dependent on the number and placement of the plurality of vertical posts secured into the base frame, with each of the cutouts 118 in the top frame aligning with each of the vertical posts, respectively. The inverted beams are then placed over the ends of the vertical posts, each post being inserted into a respective cutout 140. The inverted beams are then secured to the vertical posts through vertical web member 202 and upper vertical tab 208 using a plurality of fasteners, as described earlier herein.

At step 1210, a plurality of wall panels 802/804 are fastened to the vertical posts, and/or the base frame and/or the top frame through upper vertical tab 208 of the beams using a plurality of fasteners 802.

At step 1212, a plurality of roof panels 806 are secured to the top frame using a plurality of fasteners 802 as described earlier herein At step 1214, a plurality of floor panels 900 are secured to the base frame 102, using a plurality of fasteners 802 as described earlier herein.

Figure 13A:
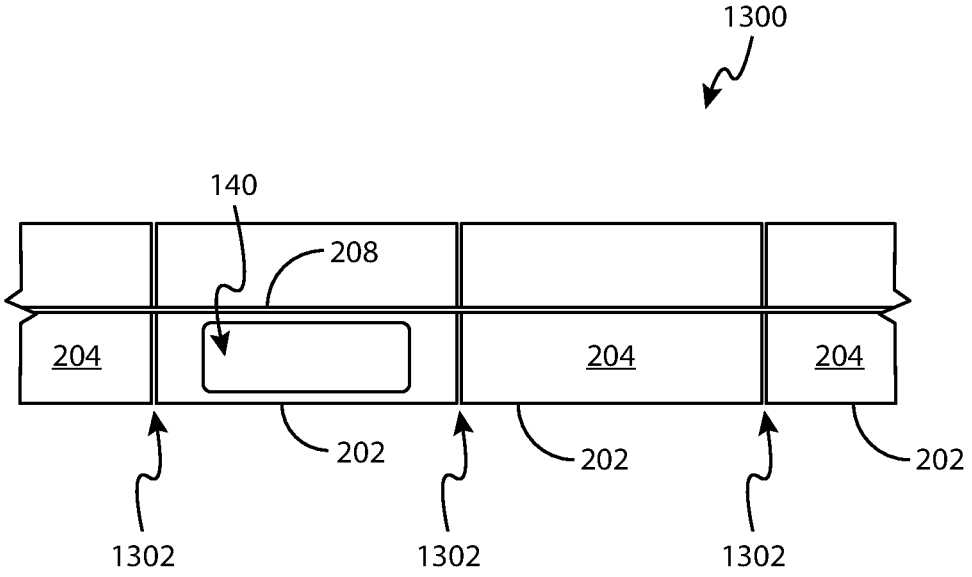
FIGS. 13A and 13B illustrate a top, plan view of another embodiment of an openC beam in an embodiment where openC beams are used to construct curved walls.
Figure 13B:
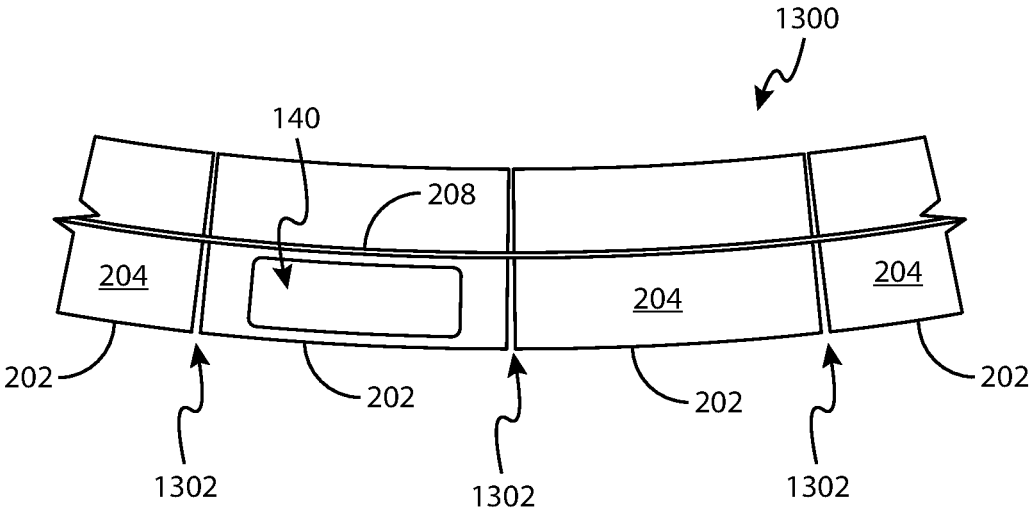

FIGS. 13A and 13B illustrate a top, plan view of another embodiment of an openC beam 1300 in an embodiment where openC beams are used to construct curved walls. In this embodiment, an openC beam similar to either openC beam 200 or openC beam 1100 is used, with an openC beam similar to openC beam 1100 preferred, as will be explained shortly. Narrow slots 1302 are cut into horizontal top flange 204, vertical web member 202 and horizontal bottom flange 206, as shown, in one embodiment, every six inches. The slots 1302 create a space inbetween beam sections approximately between 1/32 of an inch to 1/2 of an inch. In other embodiments, the slots may be formed closer together or further apart, in order to obtain a bend radius larger, or smaller, respectively, than a bend radius achieved in the embodiment shown in FIGS. 13A and 13B. Generally, the slots 1302 terminate upon reaching upper vertical tab 208 and lower vertical tab 1102 (hidden from view). In other words, neither upper vertical tab 208 nor lower vertical tab 1102 is slotted, and both remain continuous along the length of openC beam 1300. This provides support to keep openC 1300 together while horizontal top flange 204, vertical web member 202 and horizontal bottom flange 206 are disjointed from one another. Generally, openC beam 1300 comprises both an upper vertical tab 208 and a lower vertical tab 1102 to provide for maximum support, rather than an embodiment where openC beam 1300 lacks a lower vertical tab 1102.

FIG. 13B shows openC beam 1300 after it has been manipulated into a curved shape. Upper vertical tab 208 remains continuous, allowing vertical posts to be affixed thereto, as explained previously with respect to other embodiments. Lower vertical tab 1102 also remains continuous.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

I claim:

1. An openC beam used to construct a lightweight structure, comprising:

a vertical web member;

a horizontal top flange extending perpendicularly in a first direction from the vertical web member, the horizontal top flange comprising a width at least equal to a thickness of a vertical post used to create a frame of the lightweight structure in conjunction with the openC beam;

a horizontal bottom flange extending perpendicularly in the first direction and substantially parallel with the horizontal top flange;

an upper vertical tab extending substantially perpendicularly from a distal edge of the horizontal top flange away from the horizontal bottom flange; and a cutout in the horizontal top flange, the cutout sized and shaped in conformity with a cross-section of the vertical post, designed to allow a first end of the vertical post to pass through the cutout, for coupling the first end to the vertical web member.

2. The openC beam of claim 1, further comprising:

a lower longitudinal tab extending substantially perpendicularly from a distal edge of the horizontal bottom flange away from the horizontal top flange, creating a space defined by a bottom surface of the horizontal bottom flange and an inside surface of the lower longitudinal tab.

3. The openC beam of claim 2, further comprising:

a composite material formed in the space for supporting the openC beam on a foundation at a construction site.

4. The openC beam of claim 1, further comprising:

one or more slots formed at least partially through the vertical web member, the horizontal top flange and the horizontal bottom flange;

wherein the slots allow the first openC beam to be curved.

5. The openC beam of claim 1, wherein the horizontal top flange and the upper vertical tab terminate a predetermined distance from opposing ends of the openC beam.

6. A structure, comprising:

a first openC beam, the first openC beam comprising:

a vertical web member;

a horizontal top flange extending perpendicularly in a first direction from the vertical web member, the horizontal top flange comprising a width at least equal to a thickness of a vertical post;

a horizontal bottom flange extending perpendicularly in the first direction and substantially parallel with the horizontal top flange; and an upper vertical tab extending substantially perpendicularly from a distal edge of the horizontal top flange away from the horizontal bottom flange;

the vertical post, coupled substantially perpendicularly to the first openC beam at a first end of the vertical post;

a first wall panel coupled to the vertical post; and a cutout in the horizontal top flange, the cutout sized and shaped in conformity with a cross-section of the vertical post, designed to allow a first end of the vertical post to pass through the cutout, for coupling the first end to the vertical web member.

7. The structure of claim 6, wherein the horizontal top flange and the upper vertical tab terminate a predetermined distance from opposing ends of the first openC beam.

8. The structure of claim 6, further comprising:

an inverted openC beam and coupled to the vertical post at a second end of the vertical post.

9. The structure of claim 8, further comprising:

a second inverted openC beam;

a third inverted openC beam;

a fourth inverted openC beam;

wherein each of the inverted openC beams are coupled together to form a top frame;

a metallic roof panel positioned over the top frame, the metallic roof panel comprising a thickness of less than 14 gauge; and a plurality of roof fasteners for securing the metallic panel to at least a portion of the top frame.

10. The structure of claim 9, further comprising:

a second openC beam;

a third openC beam;

a fourth openC beam;

wherein each of the openC beams are coupled together to form a base frame;

a floor panel partially positioned over the horizontal bottom flange and within a space created by the vertical web member, the horizontal top flange, and the horizontal bottom flange; and a floor fastener for securing the floor panel to the horizontal bottom flange.

11. The structure of claim 6, further comprising:

a second openC beam comprising a left end coupled substantially at a ninety degree angle to a right end of the first openC beam;

a plurality of additional vertical posts coupled to the first openC beam and the second openC beam along a length of the beams; and a second wall panel coupled to the plurality of additional vertical posts.

12. The structure of claim 11, further comprising:

an L-shaped insert for coupling the first and second openC beams together, comprising a first extension and a second extension joined at substantially a 90 degree angle with respect to each other, the first extension positioned inside the right end of the first openC beam and the second extension positioned inside the left end of the second openC beam.

13. The structure of claim 11, wherein:

the horizontal top flange and the upper vertical tab terminate a predetermined distance from the right end of the first openC beam and a first end opposing the right end of the first openC beam; and the second openC beam comprises a second horizontal top flange and a second upper vertical tab, wherein the second horizontal top flange and the second upper vertical tab terminate a predetermined distance from the left end of the first openC beam and a second end opposing the left end of the first openC beam;

wherein an opening is formed at the juncture of the right end of the first openC beam and the left end of the second openC beam.

14. The structure of claim 13, further comprising:

a corner post comprising a first end coupled substantially perpendicularly to the right end of the first openC beam and the left end of the second openC beam through the opening, wherein a first planar surface of the corner post rests against the vertical web member and a second planar surface of the corner post rests against a second vertical web member of the second openC beam.

15. The structure of claim 6, further comprising:

a second openC beam positioned end-to-end with the first openC beam; and a longitudinal insert positioned within a first end of the first openC beam and a first end of the second openC beam where the first and second openC beams connect, the longitudinal insert comprising a cross-section sized and shaped the same as a cross-section of an interior of the first openC beam and the second openC beam.

16. The structure of claim 6, further comprising:

an inverted openC beam; and a plurality of additional vertical posts coupled to the first openC beam and the inverted openC beam at opposing ends of each of the plurality of additional vertical posts along a length of the beams.

17. A method for constructing a modular structure, comprising:

forming a base frame from of a plurality of openC beams, each of the openC beams comprising a vertical web member, a horizontal top flange extending perpendicularly in a first direction from the vertical web member, a horizontal bottom flange extending perpendicularly in the first direction and substantially parallel with the horizontal top flange and a upper vertical tab extending substantially perpendicularly from a distal edge of the horizontal top flange away from the horizontal bottom flange;

forming a top frame comprising a plurality of inverted openC beams;

securing a first end of each of a plurality of vertical posts, respectively, to a first openC beam of the plurality of openC beams; and securing a second end of each of the plurality of vertical posts, respectively, to a first inverted openC beam of the plurality of inverted openC beams;

wherein securing the first and second ends of each of the plurality of vertical posts comprises:

forming one or more cutouts in the horizontal top flange of the first openC beam;

forming one or more cutouts in a horizontal top flange of the first inverted openC beam, each of the cutouts sized and shaped in conformity with a cross-section of the vertical posts;

inserting the first end of each of the plurality of vertical posts through each of the one or more cutouts in the horizontal top flange of the first openC beam, respectively; and securing the first end of each of the plurality of vertical posts to the vertical web member of the first openC beam, respectively.

* * * * *